US009133638B2

(12) United States Patent
Hodak

(10) Patent No.: US 9,133,638 B2
(45) Date of Patent: Sep. 15, 2015

(54) SEALING CLOSURE FOR SWIMMING POOL SKIMMER

(71) Applicant: Michael L. Hodak, Venetia, PA (US)

(72) Inventor: Michael L. Hodak, Venetia, PA (US)

(73) Assignee: Michael L. Hodak, Venetia, PA (US)

( * ) Notice: Subject to any disclaimer, the term of this patent is extended or adjusted under 35 U.S.C. 154(b) by 219 days.

(21) Appl. No.: 13/934,583

(22) Filed: Jul. 3, 2013

(65) Prior Publication Data

US 2014/0007339 A1 Jan. 9, 2014

Related U.S. Application Data

(60) Provisional application No. 61/668,096, filed on Jul. 5, 2012.

(51) Int. Cl.
*E04H 4/00* (2006.01)
*E04H 4/12* (2006.01)

(52) U.S. Cl.
CPC ..... *E04H 4/1272* (2013.01)

(58) Field of Classification Search
CPC ..... E04H 4/1272; E04H 4/14
USPC ..... 4/507, 496
See application file for complete search history.

(56) References Cited

U.S. PATENT DOCUMENTS

| | | | | |
|---|---|---|---|---|
| 4,913,810 | A | 4/1990 | Hodak | |
| 5,285,538 | A | 2/1994 | Hodak | |
| 5,604,939 | A * | 2/1997 | Widener | 4/507 |
| 5,937,453 | A | 8/1999 | Hodak | |
| 6,966,078 | B2 * | 11/2005 | Evans et al. | 4/496 |
| 8,726,428 | B2 * | 5/2014 | Nelson | 4/496 |

* cited by examiner

*Primary Examiner* — Huyen Le
(74) *Attorney, Agent, or Firm* — The Webb Law Firm

(57) ABSTRACT

A closure assembly for a swimming pool skimmer comprising a sealing closure which is designed dimensionally to fit common rectangularly shaped skimmer openings of rectangular shape of the skimmer opening. The faceplate has a flange which overlaps the peripheral area of the skimmer flange. The closure faceplate sidewalls extend into the skimmer opening. A monolithic sealing gasket, preferably of injection molded silicone rubber or other polymeric material, closely fits around the outer perimeter of the closure faceplate sidewalls. A wedge plate member is fitted into the sealing gasket. A closure means in the form of a nut and bolt or a stud hook member and cam lock arrangement are used to exert the closing force on the wedge plate to force the sidewalls of the wedge plate member into engagement with the monolithic sealing gasket. The wedging action of the wedge plate member against the monolithic sealing gasket causes the outer sidewalls of the sealing gasket to flex outwardly and tightly engage the sidewalls of the skimmer opening to prevent water leakage into the skimmer body. In this manner, leakage of water from the poolside into the skimmer and pump conduit is prevented.

2 Claims, 8 Drawing Sheets

SEALING CLOSURE FOR SWIMMING POOL SKIMMER

CROSS-REFERENCE TO RELATED APPLICATION

This application claims priority on U.S. Provisional Application No. 61/668,096 filed Jul. 5, 2012, which is incorporated by reference in its entirety.

BACKGROUND OF THE INVENTION

1. Field of the Invention

The present invention relates generally to swimming pools and, more particularly, to sealing apparatus for closing off the sidewall opening of a skimmer to prevent water from entering the skimmer when the pool is closed for the season.

2. Brief Description of the Prior Art

It is common to employ one or more skimming devices in the sidewalls of swimming pools, hot tubs and the like to permit surface water to be drawn off by a pump, to be filtered at a remote location and then optionally heated, and returned to the pool through one or more return ports. When the pool is closed during the winter season, for example, it is sometimes desirable to maintain a lower level of water in the pool for structural purposes. Even if completely drained, the water level in the pool will naturally rise during the closed season due to rainwater and melting snow, such that the water level oftentimes rises to a level of the skimmer opening or above. In such cases, it is necessary to close off the skimmer to prevent backflow of water through the skimmer conduit to the filtration, pump equipment, and heater so as to prevent damage to the pipes, filtration equipment, and heater due to freezing during the cold winter months.

One common way of closing off the skimmer is to employ an elongated plug-like element, marketed under the trademark "GIZMO®". The plug element is threadably secured within the floor of the skimmer body to seal the conduit communicating with the pump and filtration equipment. Several other devices for sealing off a skimmer opening with a detachable cover plate or panel are disclosed in U.S. Pat. Nos. 4,913,810; 5,937,453; and 5,285,538. These prior devices either require a retrofit of the skimmer faceplate in order to make sealing contact with a closure member as in the '810 patent, or require the use of a polymeric flexible sealing member which snaps over the skimmer opening. Such faceplate seals may lose their effectiveness due to weathering of the polymeric material, and also may require special retrofitting of the skimmer opening member to provide better sealing between the skimmer and the flexible snap-on faceplate.

SUMMARY OF THE INVENTION

The present device of my invention is directed to a closure assembly for a swimming pool skimmer comprising a sealing closure which is designed dimensionally to fit common rectangularly shaped skimmer openings of various sizes. The sealing closure comprises a closure faceplate having integral sidewalls in the rectangular shape of the skimmer opening. The faceplate has a flange which overlaps the peripheral area of the skimmer flange. The closure faceplate sidewalls extend into the skimmer opening. A monolithic sealing gasket, preferably of injection molded silicone rubber or other polymeric material, closely fits around the outer perimeter of the closure faceplate sidewalls. The monolithic sealing gasket preferably carries inside tapered sidewalls. A wedge plate member having tapered sidewalls at its perimeter, for engaging the tapered inside sidewalls of the sealing gasket, is fitted into the sealing gasket. A bolt member is provided in one embodiment integral with the interior of the enclosure faceplate and extends through a bolt hole formed in an outer surface of the wedge plate. In one embodiment, a wing nut is fitted over the exposed threaded bolt on the outer surface of the wedge plate member, whereby rotation of the wing nut forces the tapered sidewalls of the wedge plate member into engagement with the monolithic sealing gasket. In another embodiment, a hook-shaped stud extends from an inner face of the closure faceplate and through an opening in the wedge plate. A cam lock is attached to the hook of the stud and moved to a closed position so as to exert a sealing force between the wedge plate and the sealing gasket. The wedging action of the wedge plate member against the monolithic sealing gasket, as the bolt and nut are tightened, or as the cam lock is moved, causes the outer sidewalls of the sealing gasket to flex outwardly and tightly engage the sidewalls of the skimmer opening. Thus, the tightening of the wing nut and the bolt against the bolt member or cam lock forcibly urges the sealing gasket into tight sealing engagement with the sidewalls of the interior of the skimmer opening sidewall to prevent water leakage into the skimmer body. In this manner, leakage of water from the poolside into the skimmer and pump conduit is prevented.

DETAILED DESCRIPTION OF INVENTION

Figure 1:
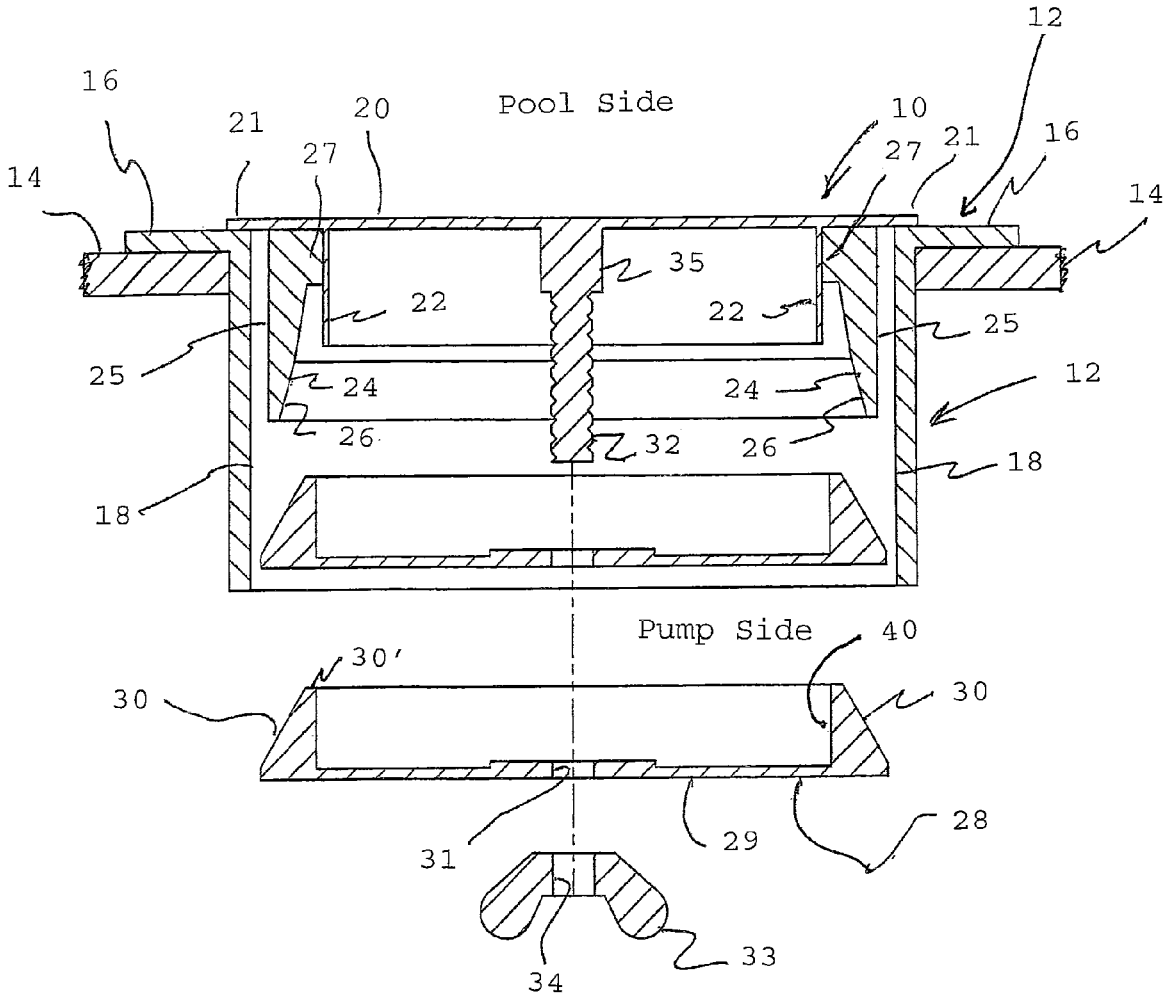
FIG. 1 is a cross-sectional exploded view of the sealing closure of the invention mounted on a typical skimmer plate opening.
Figure 2:
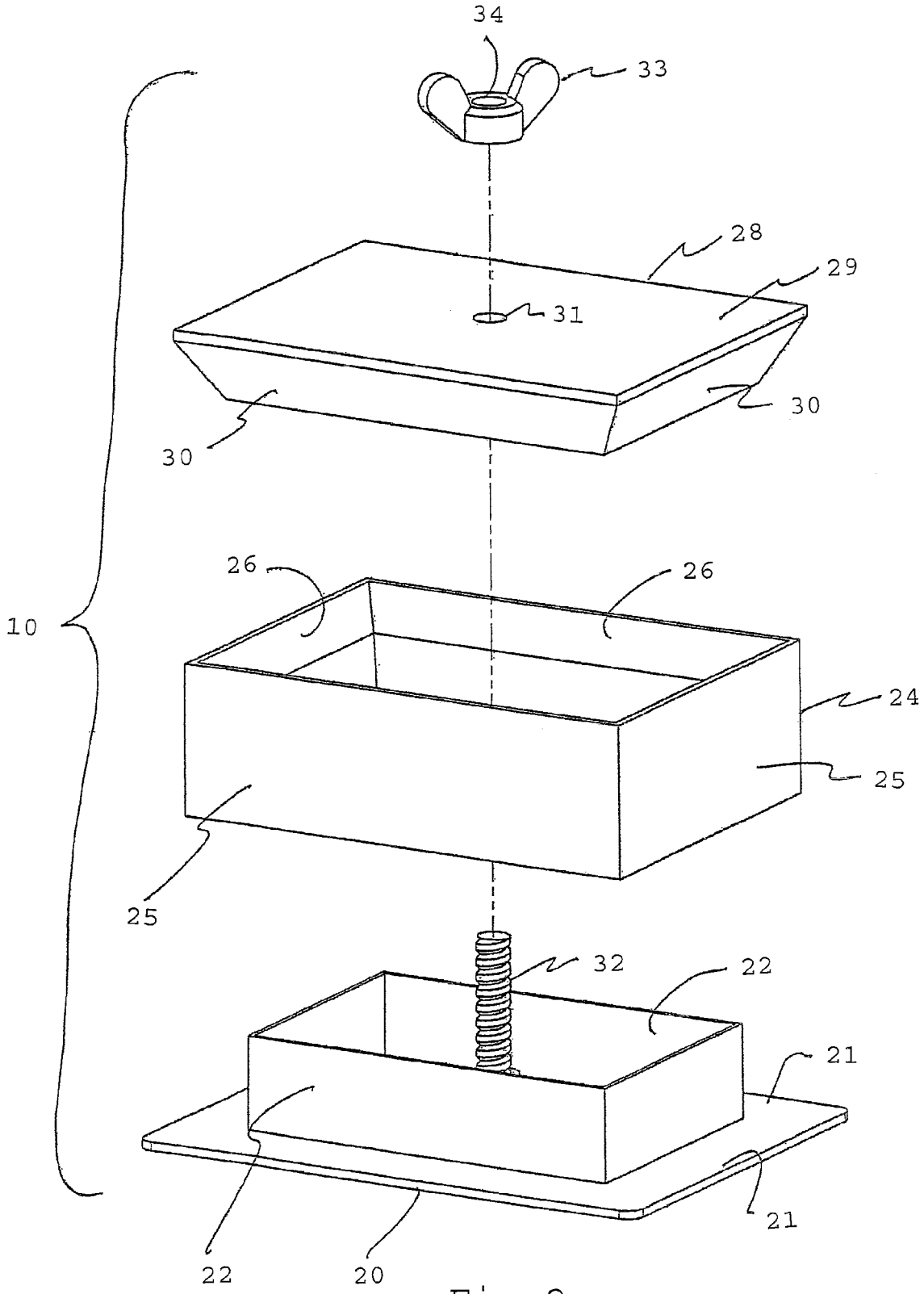
FIG. 2 is an exploded view in perspective of the various elements of the sealing closure of the invention.

Reference will now be made to the drawings showing detailed embodiments of the present invention, wherein identical reference numerals identify identical elements and prime numerals, if used, identify similar elements throughout the various drawing figures. The invention may, however, be embodied in different forms and should not be construed as being limited to the embodiments set forth herein.

FIG. 1 depicts an exploded view in cross section of the sealing closure 10 of one embodiment of the present invention as it would appear when it is to be assembled in a skimmer opening of a swimming pool skimmer 12. Skimmer 12 is mounted on a pool sidewall 14. The skimmer carries a peripheral flange 16 which is secured to the pool sidewall 14 by a plurality of screws (not shown), all of which are well known in the art. The skimmer body 12 carries sidewalls 18 which extend from the flange 16 inwardly and away from the pool sidewall 14. The opening defined by the sidewalls permits the drawing off of surface water from the pool for subsequent filtration and heating purposes. The details of the skimmer body and its function are more fully described in U.S. Pat. No. 5,285,538 to Hodak et al., the contents of which are incorporated by reference herein. Sealing closure 10 of the invention is inserted in the skimmer opening defined by the skimmer sidewalls 18. The sealing enclosure 10 comprises a closure faceplate 20 on the pool or water side of the skimmer. The closure faceplate at its outer periphery overlaps an area of the skimmer flange at 21 and acts as a stop to prevent movement of the closure faceplate 20 into the skimmer opening. The closure faceplate 20 carries sidewalls 22. The closure faceplate also, in one preferred embodiment, carries an integral bolt 32 which has an enlarged shank portion 35 for strength purposes. The closure faceplate 20 and sidewalls 22, as well as bolt 35, are preferably of a one-piece integral injection-molded piece molded from a rigid hard plastic material such as an ABS plastics resin.

A monolithic sealing gasket 24 is also provided which snugly fits around the sidewalls 22 of the closure faceplate 20. The gasket 24 carries outer sidewalls 25 with a tapered entry area of the sidewalls at 26. The sealing gasket 24 also has a thicker upper stop section 27 which rests at its face at the underside of the faceplate 20 and on its face walls along the sidewall 22. The monolithic sealing gasket 24 is preferably formed by injection molding from a silicone rubber of 30 durometer, or from a neoprene material or the like polymerized material which remains flexible and resistant to degradation. In one embodiment, the gasket 24 is secured to the underside of the closure faceplate 20 by an adhesive material at enlarged portion 27. Alternatively, the sealing gasket 24 can be held in place on the faceplate 20 by a continuous channel (not shown) formed around the underside of the faceplate 20. In such an alternate embodiment, the sealing gasket 24 would carry a protrusion at area 27 which would snap fit into the channel as disclosed in U.S. Patent Application Publication US2010/0147846 A1, the contents of which are incorporated by reference herein.

Figure 3:
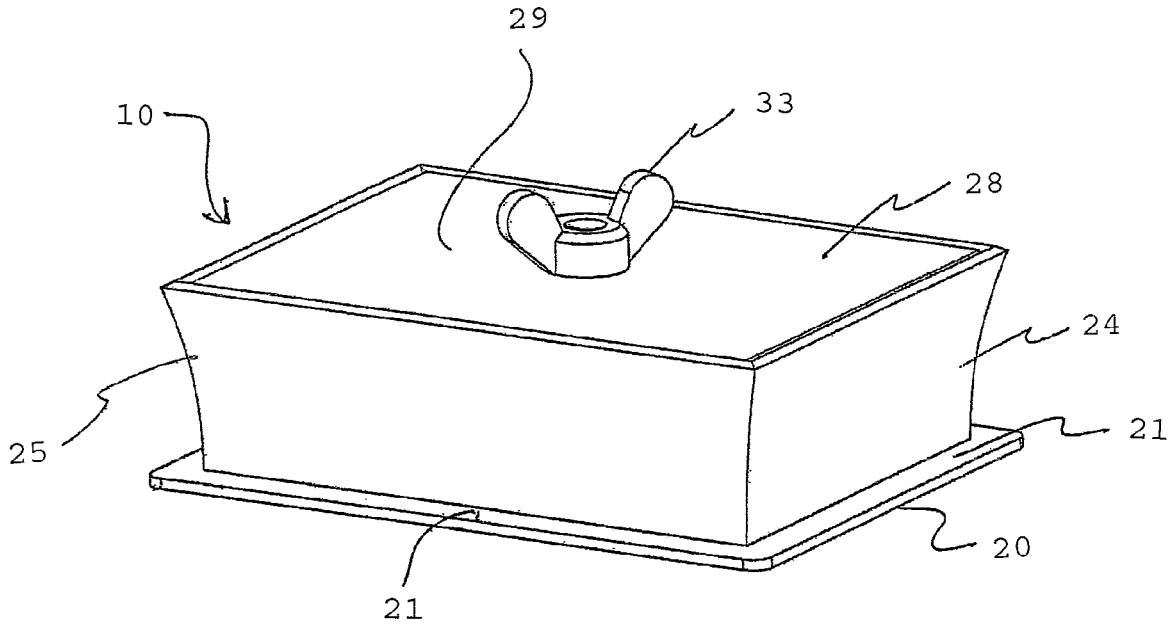
FIG. 3 is a perspective view of the sealing closure of the invention where the bolt member is in a loose, untightened position.
Figure 4:
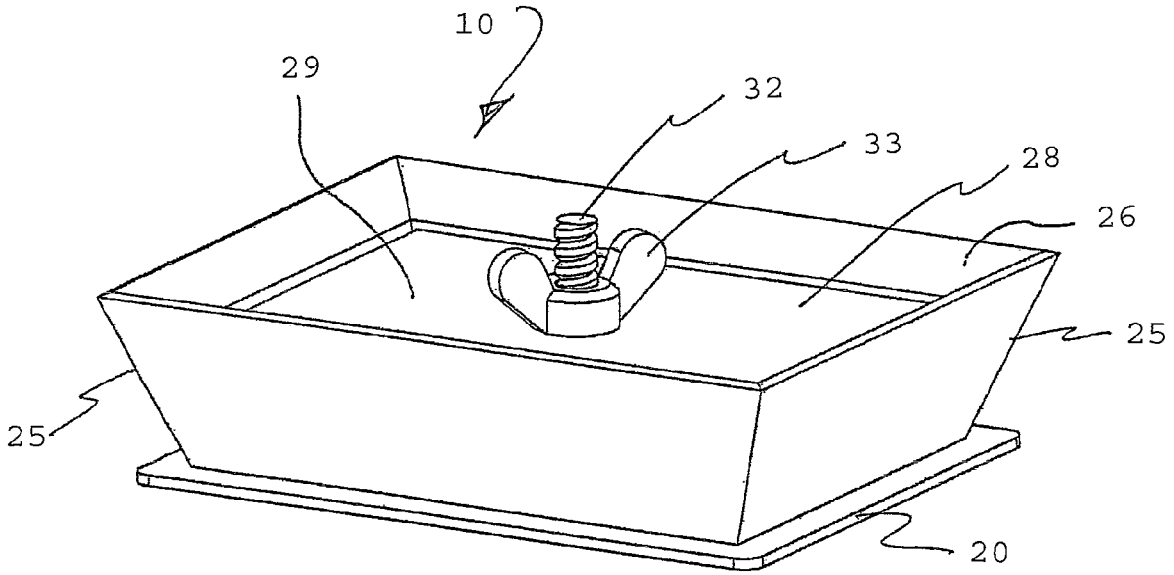
FIG. 4 is a view in perspective similar to FIG. 3 showing the bolt member in a tightened position.

A wedge plate member 28 is also provided which, in plan view, is rectangularly shaped having a flat outer plate surface 29 with tapered sidewalls 30 tapering inwardly from the surface 29 to an edge portion 30'. The wedge plate 28 also has an undercut region 40 dimensioned to permit the wedge plate to be fitted around the sidewalls 22 of the closure faceplate 20 when the parts are mated. The flat surface 29 of the wedge plate 28 has a bore hole 31 formed therethrough to permit the terminal end of the bolt 32 to extend therethrough such that a wing nut 33 having a threaded bore 34 can mate with the bolt 32. As the wing nut 33 is tightened on the bolt 32, the tapered or beveled sidewalls 30 of the wedge plate 28 engage the tapered sidewalls 26 of the sealing gasket 24 causing the outer sidewalls 25 of the sealing gasket 24 to begin to flexibly flare outwardly, as shown in FIG. 3. When fully tightened, as shown in FIG. 4, the sealing assembly 10 has the outer sidewalls 25 of the sealing gasket 24 expanded and flared outwardly so that they will tightly, sealingly engage the sidewall 18 of the skimmer opening, forming a watertight seal therearound. The four corners of the beveled edges of the wedge plate 28 may be formed in an outwardly flared fashion so as to ensure that the four corners of the gasket 24 tightly seal the corners of the sidewall 18 of the skimmer opening (not shown). In this manner, no water can enter the sealing closure and skimmer opening from the poolside. Thus, no water can enter the skimmer body, pump pipe, pump, filtration equipment, or heater from the pool.

Figure 5:
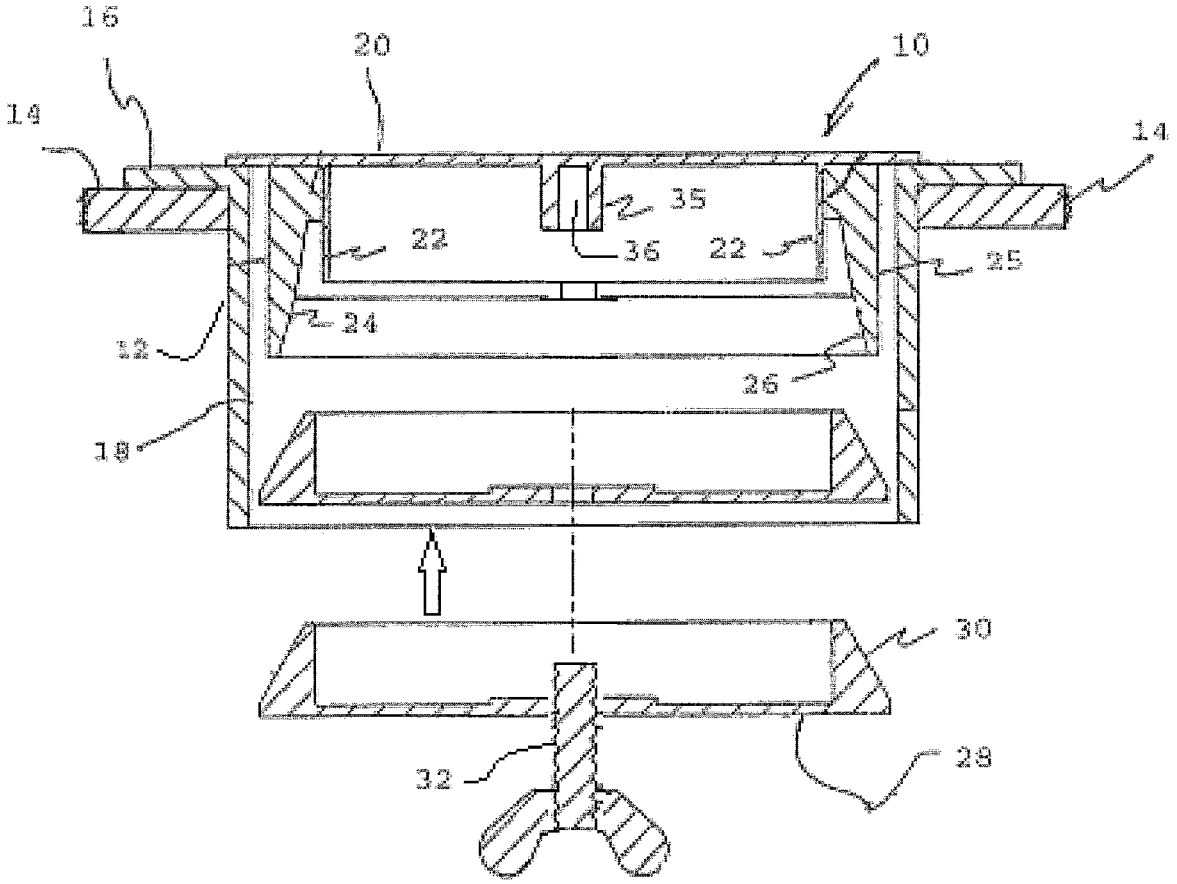
FIG. 5 is a cross-sectional view of the sealing closure of the invention showing an alternate embodiment of the bolt member.

In another presently preferred embodiment shown in FIG. 5, a threaded shank 35' may be provided on the inside surface of the closure faceplate 20 to permit the insertion of a bolt 32' from the outside of the wedge plate member 28. The same sealing action as described above of the closure 10 takes place as the bolt 32' is screwed into the shank 35'.

In a still further embodiment of my invention, a closure plate is provided having a rectangular shape, slightly larger than the skimmer opening such that it engages the skimmer flange 16 at area 21 as shown in FIG. 1. In this embodiment, the sealing gasket is configured to snap into a channel formed on the underside of the closure plate as previously described. However, in this embodiment no wedge plate or bolt is employed by virtue of the fact that the sealing gasket carries an outwardly flared and curved flexible lip which tightly engages the sidewalls 18 of the skimmer opening when the closure plate is forcibly inserted into the skimmer opening. The closure plate remains in place due to the interference fit between the flexed sealing gasket lip and the skimmer sidewalls.

In the sealed position, the underside of the closure plate rests against the skimmer flange 12 at area 21. The underside of the closure plate could have several undercut notched areas formed therein to permit the insertion of a screwdriver tip, for example, to permit removal of the closure plate from the skimmer opening in the spring when the pool is to be opened.

Figure 6:
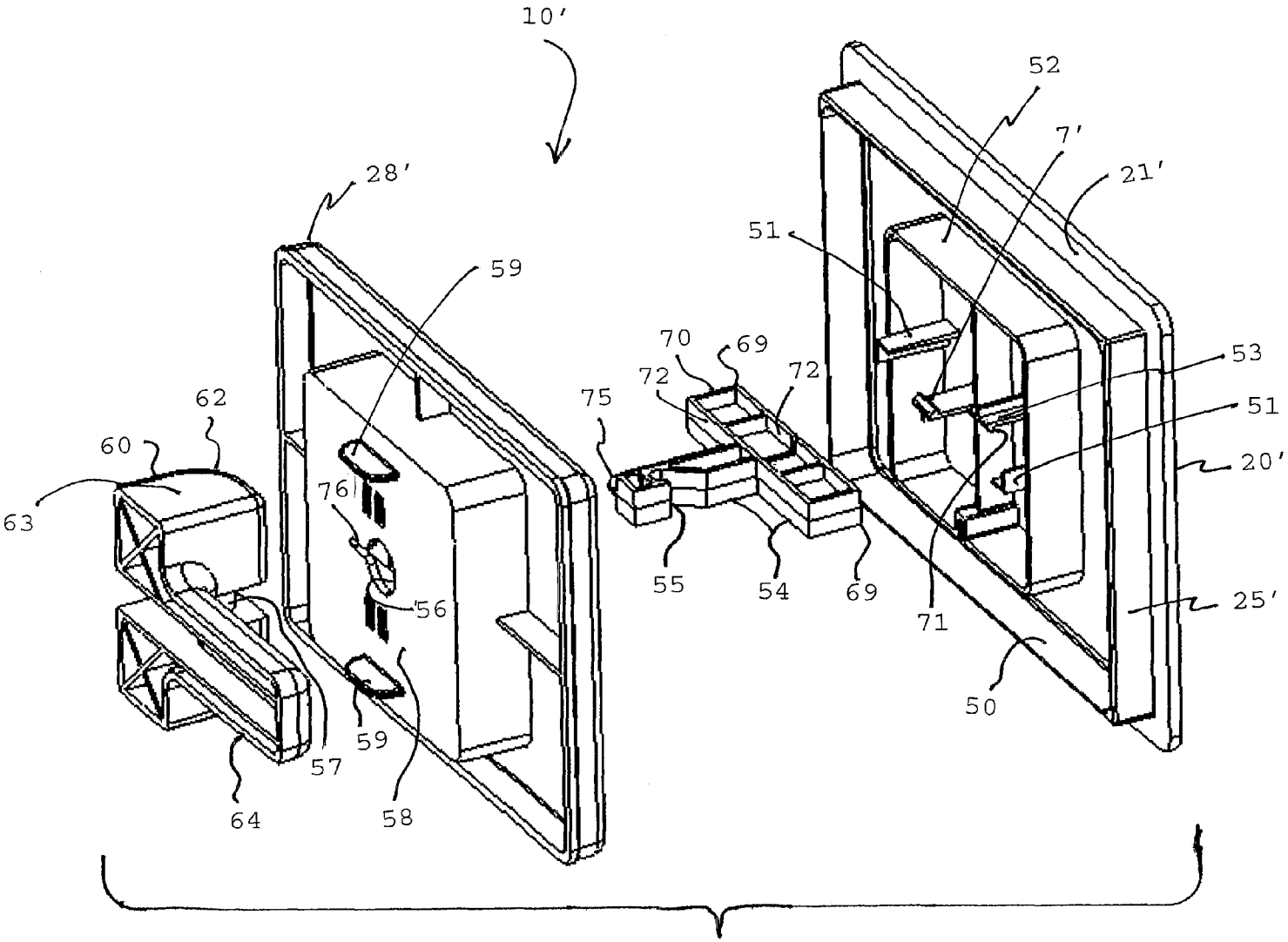
FIG. 6 is an exploded view of an alternate embodiment of the skimmer sealing closure of the invention wherein the bolt is replaced with a hook stud and cam lock members.
Figure 7:
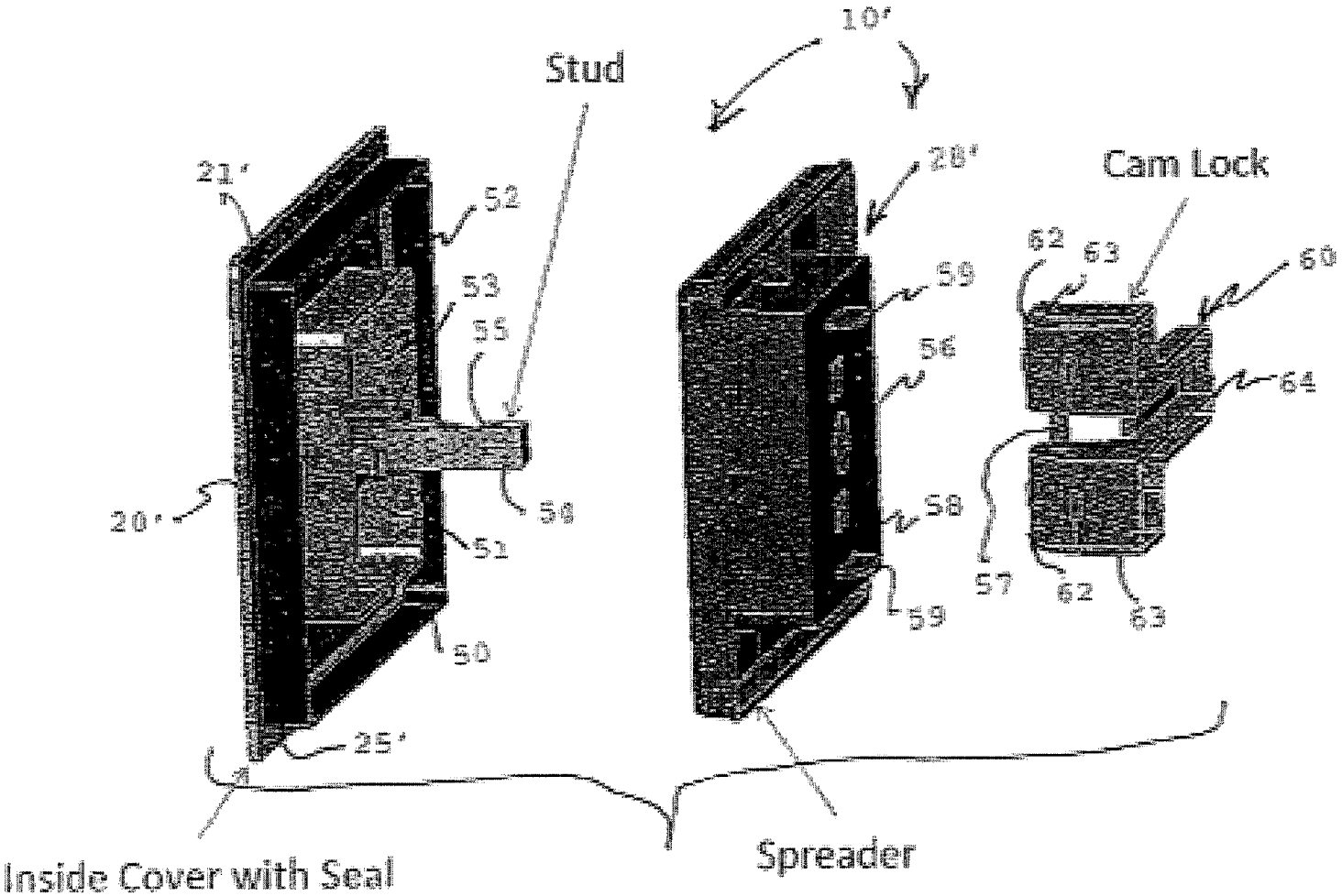
FIG. 7 is an exploded view of the sealing closure similar to FIG. 6.
Figure 8:
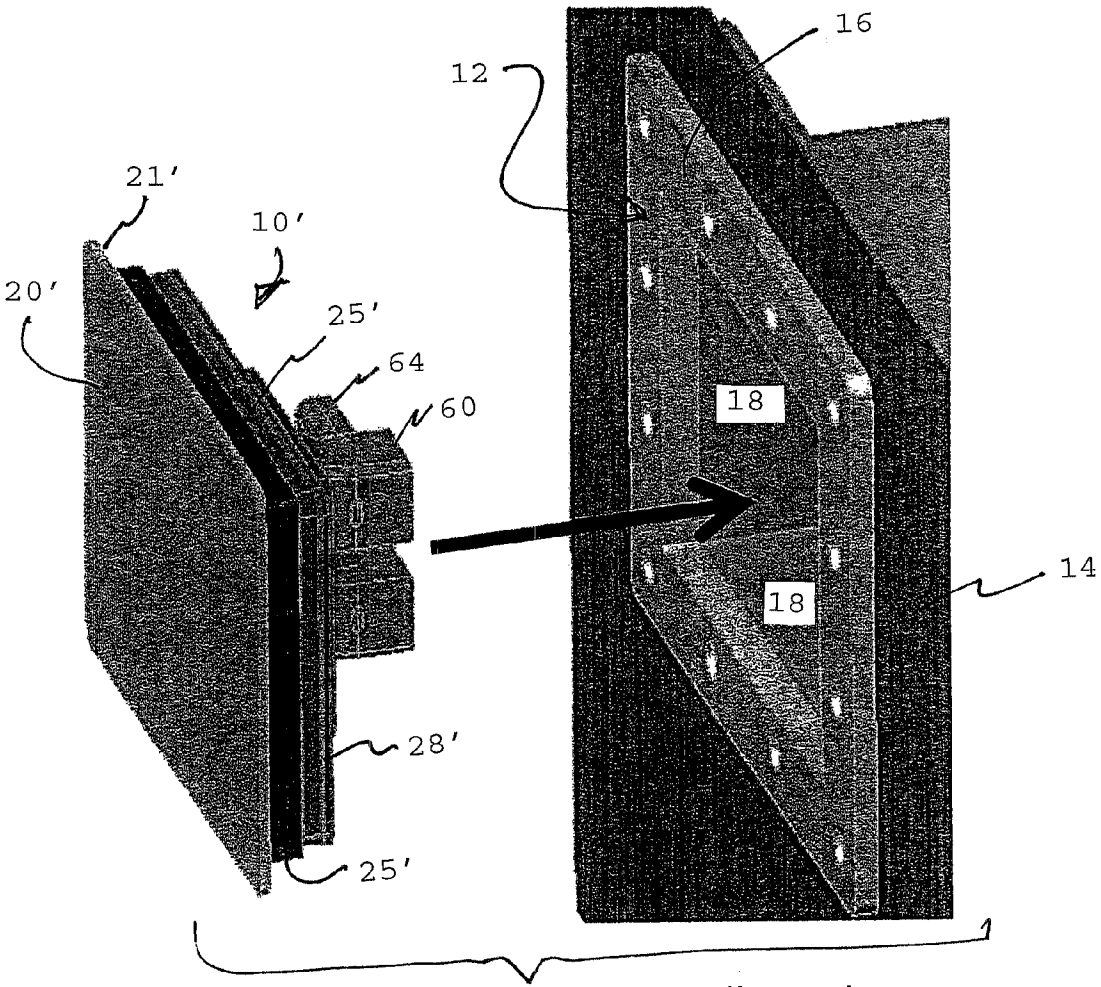
FIG. 8 is an exploded view of the sealing closure being inserted into the opening of a skimmer plate prior to sealing.

A further presently preferred embodiment of the skimmer sealing closure 10' of the invention is shown in FIGS. 6-8. The sealing closure 10' includes a closure faceplate 20' which has an outer area 21' which overlaps a portion of the skimmer flange 16 when the sealing closure 10' is inserted into the skimmer opening defined by the skimmer sidewalls 18, see FIG. 8. The faceplate 20' carries an integral rectangular flange 50 on its inward side (away from the pool) which, in turn, serves as a backup for an elastomeric sealing member 25' or sealing gasket which is mounted on the outer periphery of the flange 50. The sealing member 25' is adapted to sealingly engage the sidewalls 18 of the skimmer opening when a spreader plate 28' or wedge plate is forced into engagement with the faceplate 20' and exerts a rearward force thereon by way of a hook stud 54 attached to the faceplate and acted upon by a cam lock 60 which exerts the desired rearward force. The hook stud 54 carries a hook portion 55 which extends through a bore 56 formed through the spreader or wedge plate 28' whereupon the hook portion 55 can engage a bar 57 carried by the cam lock 60. The cam lock 60 carries curved cam surfaces 62 and an outwardly extending arm 64. When the bar 57 of the cam lock 60 engages the hook portion 55 of the hook stud 54, the curved cam surfaces 62 press against a rear face 58 of the spreader plate 28' and exert a closing force thereon when the arm 64 is moved.

The rear face 58 of the spreader plate 28' also has a pair of spaced-apart tabs 59 to nearly engage side edges 63 of the cam lock 60 so as to center the cam lock 60 with the bore 56 and enable the alignment of the hook portion 55 with the bar 57 of the cam lock.

The faceplate 20' also carries an integrally molded rectangular member 52 located inwardly of the rectangular flange 50 and projections 51 and 53. The projections 51 are right angle members adapted to engage and align opposed corners 69 of the beam portion 70 of the stud 54. The projections 53 have latching hooks 71 to snap onto the flanges 72 carried by the beam portion 70 on opposed sides of the beam portion. In this manner, the stud 54 and hook 55 are snapped into tight engagement with the faceplate 20'.

The faceplate 20', wedge or spreader plate 28', and cam lock 60 are all preferably made from injection molded plastic materials such as ABS plastic material or the like.

The hook portion 55 of the stud 54 preferably carries an outwardly extending alignment web 75 that extends longitudinally along a side of the stud 54, on the side opposite the hook portion 55. The web 75 is configured to slidably fit into a key slot 76 formed outwardly from the bore 56 of the spreader plate 28'. When the hook portion 55 of the stud 54 is inserted into the bore 56, the web 75 enters the key slot 76 to align the hook portion 55 with the bar 57 of the cam lock 60 and prevents the stud 54 from turning or twisting relative to the spreader plate 28' when the cam lock 60 is moved to apply a rearward force on the assembly 10', see FIG. 6.

FIG. 7 is similar to the exploded view of FIG. 6 except from a reversed side to show additional details, such as the bar 57 of the cam lock 60. FIG. 7 also shows the stud 54 snapped into engagement with the rear side of the faceplate 20'.

FIG. 8 depicts the sealing closure 10' of the invention in an assembled state prior to use in sealing off a skimmer opening. In the assembled state shown in FIG. 8, the closure plate 10' has the closure faceplate 20', spreader or wedge plate 28', and the cam lock 60 mated together and ready to be placed into the opening of the skimmer 12. The assembled closure plate is inserted into the opening of the skimmer from the pool side such that the flange 21' of the closure faceplate 20' rests against the flange 16 of the skimmer 12 with the cam lock 60 in the unlocked position, i.e., wherein the cam lock handle 64 is parallel to the plane of the plate 20'. After insertion, the handle 64 is moved to a locking position where the handle is perpendicular to the plane of plate 20'. As the handle 64 is moved to the perpendicular, locking position, the cam lock 60 forces the spreader or wedge plate 28' into engagement with the inside of the elastomeric sealing member 25 forcing it into sealing engagement with the sidewalls 18 of the skimmer 12 to prevent water leakage into the skimmer.

While specific embodiments of the invention have been described in detail, it will be appreciated by those skilled in the art that various modifications and alternatives to those details could be developed in light of the overall teachings of the disclosure. The presently preferred embodiments described herein are meant to be illustrative only and not limiting as to the scope of the invention which is to be given the full breadth of the appended claims and any and all equivalents thereof.

The invention claimed is:

1. A closure assembly for closing off a skimmer opening for a swimming pool comprising:

a closure faceplate having integral sidewalls in the rectangular shape of the skimmer opening;

said closure faceplate also having a flange which overlaps a peripheral area of the skimmer opening;

the closure faceplate sidewalls extending into the skimmer opening;

a monolithic sealing gasket, fitting around an outer perimeter of the closure faceplate sidewalks;

a wedge plate member for engaging inside sidewalls of the sealing gasket, fitted into the sealing gasket; and closure means for exerting a force between the closure faceplate and the wedge plate to pull the faceplate and wedge plate together, wherein the movement of the wedge plate member against the sealing gasket causes outer sidewalls of the sealing gasket to flex outwardly and tightly engage the sidewalls of the skimmer opening, forcibly urging the sealing gasket into tight sealing engagement with the sidewalls of the skimmer opening to prevent water leakage into the skimmer, preventing leakage of water from the poolside into the skimmer, wherein the closure means comprises:

a stud member for attachment to the closure faceplate, the stud member extending rearwardly from the closure faceplate and having a hook portion at a distal end;

the wedge plate member having a bore hole formed therethrough to allow passage of the hook portion of the stud, and a cam lock fitted on a rear surface of the wedge plate member for attachment to the hook portion of the stud, whereby movement of the came lock forces the wedge plate member into engagement with the sealing gasket.

2. The closure member of claim 1, wherein the closure faceplate, wedge plate member, and cam lock are of an injection molded plastic material.

* * * * *